US007714795B2

(12) United States Patent
Wen et al.

(10) Patent No.: US 7,714,795 B2
(45) Date of Patent: May 11, 2010

(54) MULTI-BAND ANTENNA APPARATUS DISPOSED ON A THREE-DIMENSIONAL SUBSTRATE, AND ASSOCIATED METHODOLOGY, FOR A RADIO DEVICE

(75) Inventors: Geyi Wen, Waterloo (CA); Qinjiang Rao, Waterloo (CA); Mark Pecen, Waterloo (CA)

(73) Assignee: Research in Motion Limited, Waterloo (CA)

( * ) Notice: Subject to any disclaimer, the term of this patent is extended or adjusted under 35 U.S.C. 154(b) by 176 days.

(21) Appl. No.: 11/843,840

(22) Filed: Aug. 23, 2007

(65) Prior Publication Data

US 2009/0051615 A1 Feb. 26, 2009

(51) Int. Cl.
*H01Q 1/38* (2006.01)

(52) U.S. Cl. ..... 343/860; 343/700 MS; 343/702; 343/895

(58) Field of Classification Search ..... 343/745, 343/749, 791, 860, 895, 900, 700 MS, 702, 343/750, 793, 795, 806, 850, 852
See application file for complete search history.

(56) References Cited

U.S. PATENT DOCUMENTS

| | | | | |
|---|---|---|---|---|
| 3,573,840 | A * | 4/1971 | Gouillou et al. | 343/895 |
| 4,323,900 | A * | 4/1982 | Krall et al. | 343/700 MS |
| 5,134,422 | A * | 7/1992 | Auriol | 343/895 |
| 5,324,553 | A * | 6/1994 | Ovshinsky et al. | 427/571 |
| 6,054,956 | A * | 4/2000 | Mandai et al. | 343/702 |
| 6,097,934 | A * | 8/2000 | Spall et al. | 455/575.7 |
| 6,112,102 | A * | 8/2000 | Zhinong | 455/552.1 |
| 6,407,710 | B2 * | 6/2002 | Keilen et al. | 343/702 |
| 6,433,755 | B1 * | 8/2002 | Kuramoto | 343/895 |
| 6,542,124 | B1 * | 4/2003 | Yoon | 343/700 MS |
| 6,750,821 | B2 * | 6/2004 | Fang et al. | 343/700 MS |
| 6,842,148 | B2 * | 1/2005 | Hendler et al. | 343/702 |
| 6,987,494 | B2 * | 1/2006 | Keren | 343/895 |
| 7,042,418 | B2 * | 5/2006 | Fujimura et al. | 343/895 |
| 7,084,825 | B2 * | 8/2006 | Sakae et al. | 343/788 |
| 7,236,141 | B2 * | 6/2007 | Huang | 343/895 |
| 2002/0145569 | A1 | 10/2002 | Onaka et al. | |
| 2004/0125032 | A1 | 7/2004 | Ikuta et al. | |
| 2005/0156790 | A1 | 7/2005 | Asai et al. | |
| 2007/0222697 | A1 * | 9/2007 | Caimi et al. | 343/861 |
| 2008/0036666 | A1 * | 2/2008 | Shih | 343/702 |

FOREIGN PATENT DOCUMENTS

| | | | |
|---|---|---|---|
| EP | 1414108 | A2 | 4/2004 |
| WO | 2006073034 | A1 | 7/2006 |

* cited by examiner

*Primary Examiner*—Douglas W Owens
*Assistant Examiner*—Chuc D Tran

(57) ABSTRACT

Antenna apparatus, and an associated methodology, for a multi-frequency-band-capable radio device, such as a quad-band mobile station. The antenna apparatus is formed from a three-dimensional rectilinear non-conductive dielectric antenna substrate, such as cube. An elongated radiation element is disposed over multiple surfaces of the antenna substrate. A T-shaped impedance matching element located at the end of the radiation element permits the antenna input impedance to be matched to a communications device. The length of the radiation element is selected to be substantially equal to a quarter wavelength of the lowest frequency band at which the antenna operates.

43 Claims, 10 Drawing Sheets

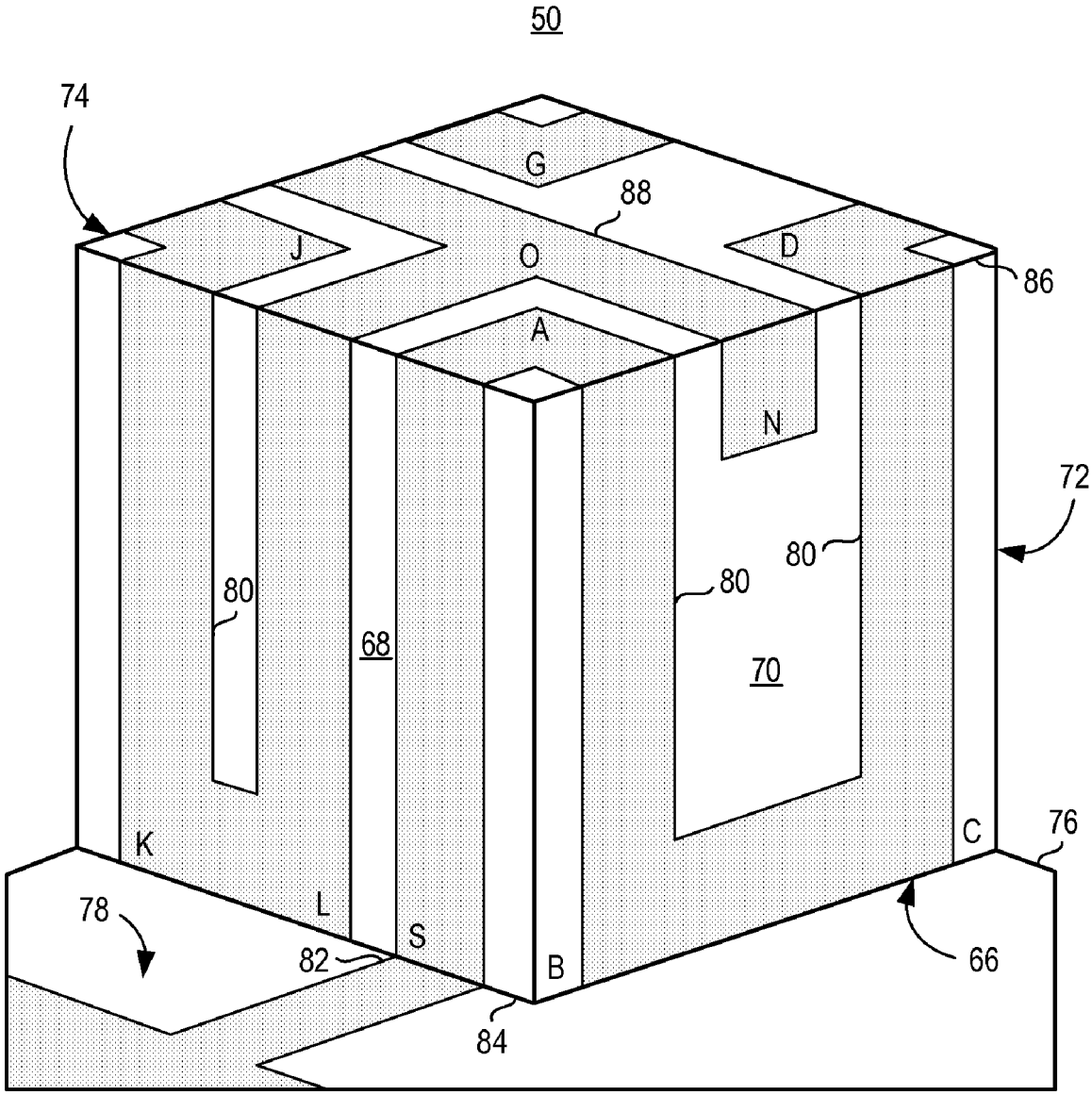
FIG. 3
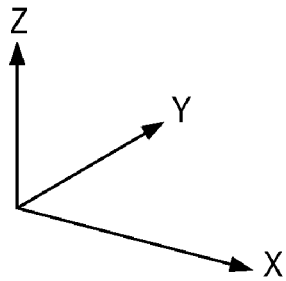

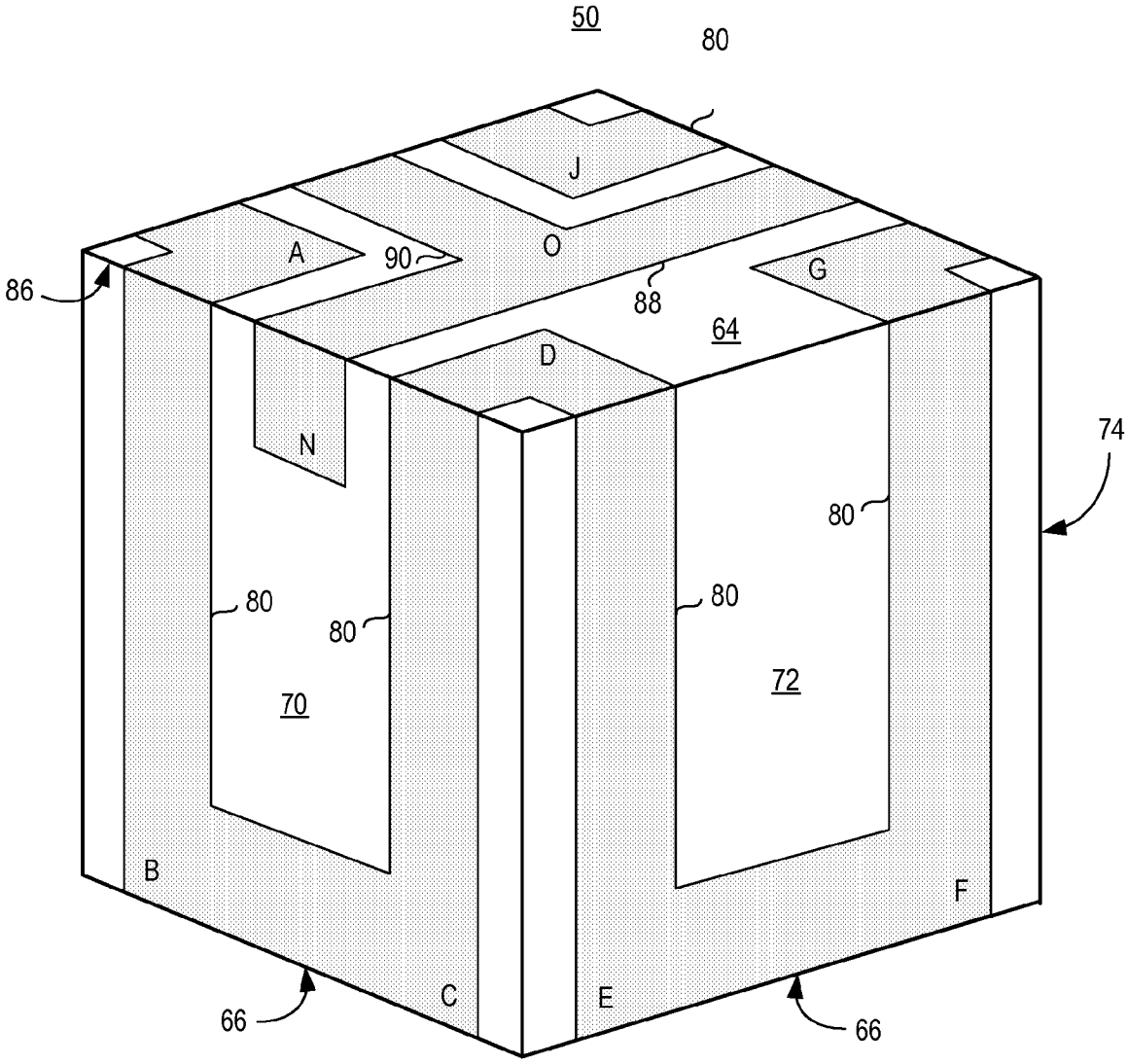
FIG. 4
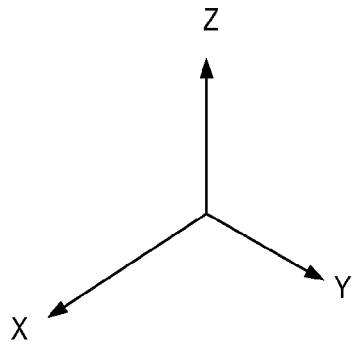

MULTI-BAND ANTENNA APPARATUS DISPOSED ON A THREE-DIMENSIONAL SUBSTRATE, AND ASSOCIATED METHODOLOGY, FOR A RADIO DEVICE

The present invention relates generally to an antenna construction for a mobile station, or other radio device, operable over multiple frequency bands. More particularly, the present invention relates to antenna apparatus, and an associated methodology for forming a hybrid strip antenna of a multi-mode mobile station, or other radio device, operable, e.g., at the 800/900/1800/1900/2100 MHz frequency bands.

The antenna includes radiation elements comprising a strip including an impedance matching element disposed upon the external surfaces of a three-dimensional rectilinear substrate, such as a parallelepiped, cube, or pyramidal frustum. The length of the strip is chosen to efficiently transduce RF energy in at least one frequency band of as many as four or more frequency bands. Since a relatively long strip antenna is wound around a very compact substrate, the antenna is of compact dimensions and exhibits stable and relatively wide resonant frequency band characteristics and radiation patterns.

BACKGROUND OF THE INVENTION

In modern society, the ready availability and access to mobile radio communication systems through which to communicate is a practical necessity. Cellular, and cellular-like, communication systems are exemplary radio communication systems whose infrastructures have been widely deployed and regularly utilized by many. Successive generations of cellular communication systems have been developed, and their operating parameters and protocols are set forth in standards promulgated by standard-setting bodies. And, successive generations of network apparatus have been deployed, each operable in conformity with an associated operating standard.

Early-generation cellular communication systems provided voice communication services and limited data communication services. Successor-generation, cellular communication systems provide increasingly data-intensive communication services. Differing operating standards not only provide different communication capabilities, but utilize different communication technologies and differing frequencies of operation in different frequency bands. The installation of different types of cellular communication systems is sometimes geographically dependent. That is to say, in different areas, network infrastructures, operable pursuant to different types of operating standards, are deployed. The network infrastructures deployed in the different areas are not necessarily compatible. A mobile station operable to communicate by way of network infrastructure constructed in conformity with one operating specification is not necessarily operable to communicate by way of network infrastructure operable pursuant to another operating standard.

So-called, multi-mode mobile stations have been developed that provide the mobile station with communication capability in more than one, i.e., multiple, communication systems, which also operate at different frequencies in different frequency bands. Generally, such multi-mode mobile stations automatically select the manner by which the mobile station is to be operable, responsive to the detected network infrastructure in whose coverage area that the mobile station is positioned. If positioned in the coverage area of the network infrastructures of more than one type of communication system with which the mobile station is capable of communicating, selection of a network infrastructure through which to communicate is made pursuant to a preference scheme, or manually. When provided with multi-mode capability, the mobile station contains circuitry and circuit elements permitting its operation to communicate pursuant to each of the communication systems. Most simply, a multi-mode mobile station is formed of separate circuitry, separately operable to communicate pursuant to the different operating standards. Sometimes, to the extent that circuit elements of the different circuit paths can be shared, parts of the separate circuit paths are constructed to be intertwined, or otherwise shared. By sharing circuit elements, the circuitry size and part count is reduced, resulting in cost and size savings.

Sharing of antenna transducer elements between the different circuit paths, however, presents unique challenges. The required size of an antenna transducer element is, in part, dependent upon the frequencies of the signal energy that is to be transduced by the transducer element. And, as mobile station constructions become increasingly miniaturized, housed in housings of increasingly small package sizes, antenna transducer design becomes increasingly difficult, particularly in multi-mode mobile stations when the different modes operate at different frequencies. Significant effort has been exerted to construct an antenna transducer, operable over multiple frequency bands, and also of small dimension to permit its positioning within the housing of a mobile station of compact size.

A PIFA (Planar Inverted-F Antenna) has been used in multi-mode mobile stations because of its relatively compact size, low profile and because it permits dual-band radiation, however, PIFA antennas have narrow bandwidths. In order to enhance the bandwidth of a PIFA, the structure of the PIFA is sometimes combined together with a parasitic element, or a multi-layered, three-dimensional structure. Such additions, however, increase the volumetric dimensions of the antenna, as well as its weight. The additional resonant branches make the antenna difficult to tune and sometimes introduce EMC and EMI, which interferes with transducing of signal energy. A need therefore exists for an improved small-dimension antenna structure which is also capable of use in multiple different frequency bands.

It is in light of this background information related to antenna transducers for radio devices that the significant improvements of the present invention have evolved.

BRIEF DESCRIPTION OF THE DRAWINGS

FIG. 3 illustrates a close-up perspective view of the embodiment depicted in FIG. 2.

FIG. 4 illustrates another close-up perspective view of the embodiment depicted in FIG. 2 but viewed from a different direction than shown in FIG. 3.

DETAILED DESCRIPTION

Figure 1:
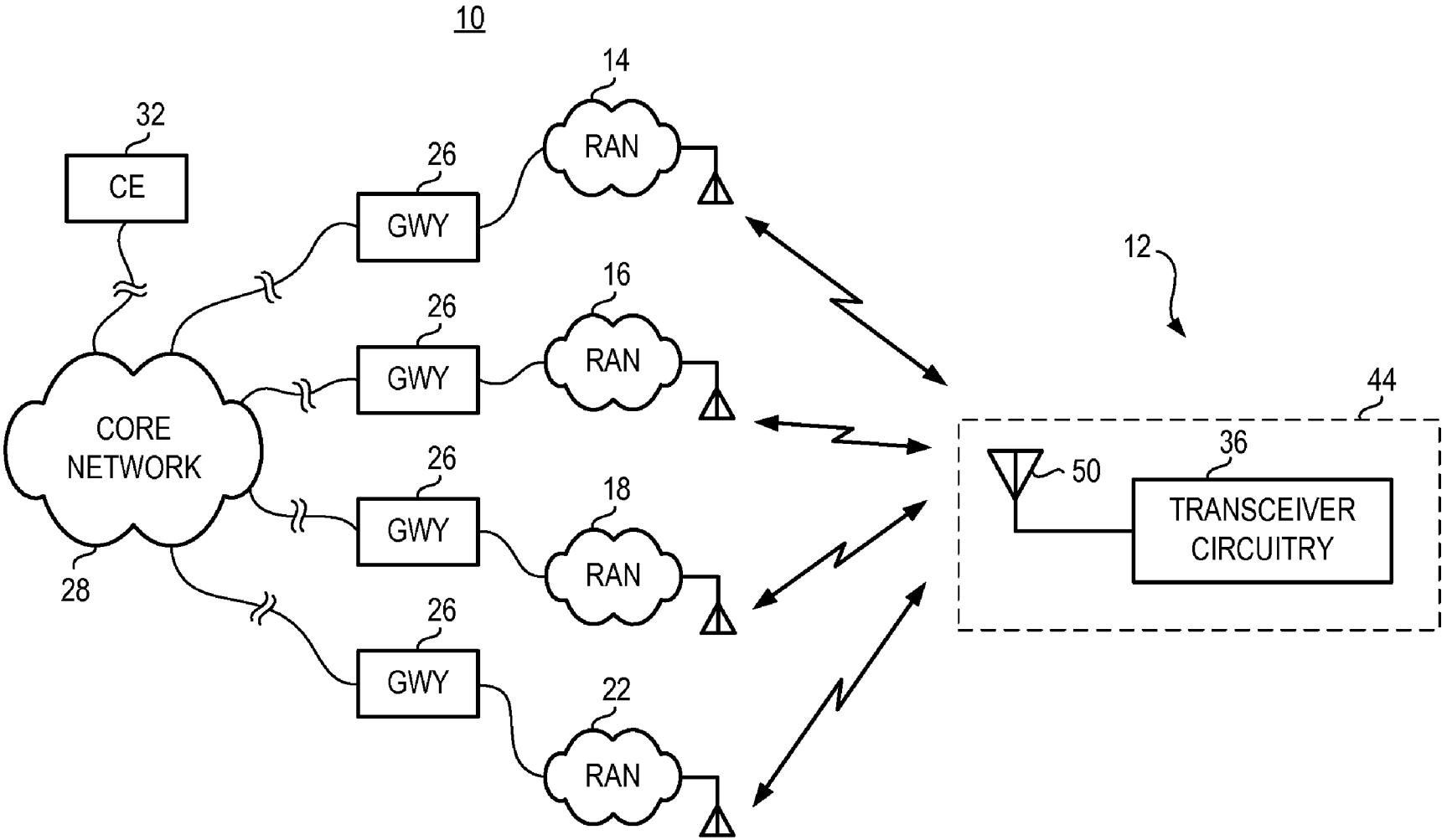
FIG. 1 illustrates a functional block diagram of a radio communication system in which an embodiment of the present invention is operable.

The present invention, accordingly, advantageously provides compact, lightweight antenna apparatus, and an associated method, for a mobile station, or other radio device, operable over multiple frequency bands.

Through operation of an embodiment of the present invention, a manner is provided by which to form a hybrid strip antenna of a multi-mode mobile station, or other radio device, operable, e.g., at the 800/900/1800/1900 MHz frequency bands.

In one aspect of the present invention, an antenna for a multi-mode mobile station is formed of a cube-shaped dielectric antenna substrate, the surfaces of which carry an end-fed antenna strip, formed of a strip of metal or other conductive material having a length, width and thickness. The length of the strip is much longer than the dimensions of any one face of the antenna substrate, requiring the strip to be folded at least part way over different faces of the antenna substrate. In other words, the length of the antenna strip is multiples of the dimensions of any one face of the cube. The antenna includes a feed point at one end of the strip and a "T"-shaped impedance matching/adjustment element at the end of the strip opposite the feed point.

The cube dimensions and the length and width of the radiation element, which of course also receives signals, are selected so that the radiation element can be "folded" across or "wrapped" around several faces of the cube without the radiation element overlapping itself and without the edges of the radiation element abutting each other. The cube dimensions are also selected so that the cube can fit within the housing of a mobile station.

In the embodiment depicted in the figures, the length of the strip forming the antenna element was approximately one-quarter the wavelength of a signal in the 800 MHz frequency band, and it effectuated resonance in both the 800 and 900 MHz bands. The antenna was also resonant in the 1800, 1900 and 2100 MHz bands.

Since the length of the metal strip forming the radiator is such that the radiator is wrapped around different faces of the cube, the strip forming the radiation element can be thought of, and also described as, several different substantially equal-length conductive segments that are electrically connected to each other in series. Successive segments are joined to each other on the cube face such that each segment's length dimension is orthogonal to the length dimension of adjacent segments. In the embodiments shown, each cube face supports more than one antenna segment. The impedance matching element at the terminus end of the strip is also folded across cube faces.

Due to the compact size, stability of operation, and stable radiation pattern provided by the antenna, the antenna is advantageously utilized in a mobile station, or other radio device, of small volumetric dimensions.

In these and other aspects, therefore, a folded strip antenna, and an associated methodology is provided for a multi-band communication device. The folded strip antenna is embodied by forming a dielectric material into the shape of a cube. A radiation element, such as a thin, flat metal strip, has a length and width such that the strip can be folded to extend at least part way across several of the different faces of the cube.

Turning, therefore, first to FIG. 1, a radio communication system, shown generally at 10, provides for radio communications with mobile stations, of which the mobile station 12 is representative. The mobile station 12 is here representative of a quad-mode mobile station, capable of communicating at the 800/900/1800/1900 MHz frequency bands. Such a mobile station is sometimes referred to as a world-band mobile station as the mobile station is operable in conformity with the operating specifications and protocols of the cellular communication systems that presently are predominant. More generally, the mobile station is representative of various radio devices that are operable over multiple bands or large bandwidths at relatively high frequencies.

Radio access networks 14, 16, 18, and 22 are representative of four radio networks operable respectively at the 800, 900, 1800, and 1900 MHz frequency bands, respectively. When the mobile station 12 is positioned within the coverage area of any of the radio access networks 14-22, the mobile station is capable of communicating therewith. If the separate networks have overlapping coverage areas, then the selection is made as to which of the networks through which to communicate. The radio access networks 14-22 are coupled, here by way of gateways (GWYs) 26 to a core network 28. A communication endpoint (CE) 32 that is representative of a communication device that communicates with the mobile station.

The mobile station 12 includes a radio transceiver having transceiver circuitry 36 capable of transceiving communication signals with any of the networks 14-22. The transceiver circuitry includes separate or shared transceiver paths constructed to be operable with the operating standards and protocols of the respective networks. The radio station further includes an antenna 50 of an embodiment of the present invention. The antenna is of characteristics to be operable at the different frequency bands at which the transceiver circuitry and the radio access networks are operable. Here, the antenna 50 is operable at the 800, 900, 1800, and 1900 MHz frequency bands. In the exemplary implementation, the antenna 50 is housed together with the transceiver circuitry, in a housing 44 of the mobile station. As the space within the housing that is available to house the antenna is limited, the dimensions of the antenna 50 are correspondingly small while providing for the transducing of signal energy by the antenna over broad frequencies at which the mobile station is operable.

Figure 2:
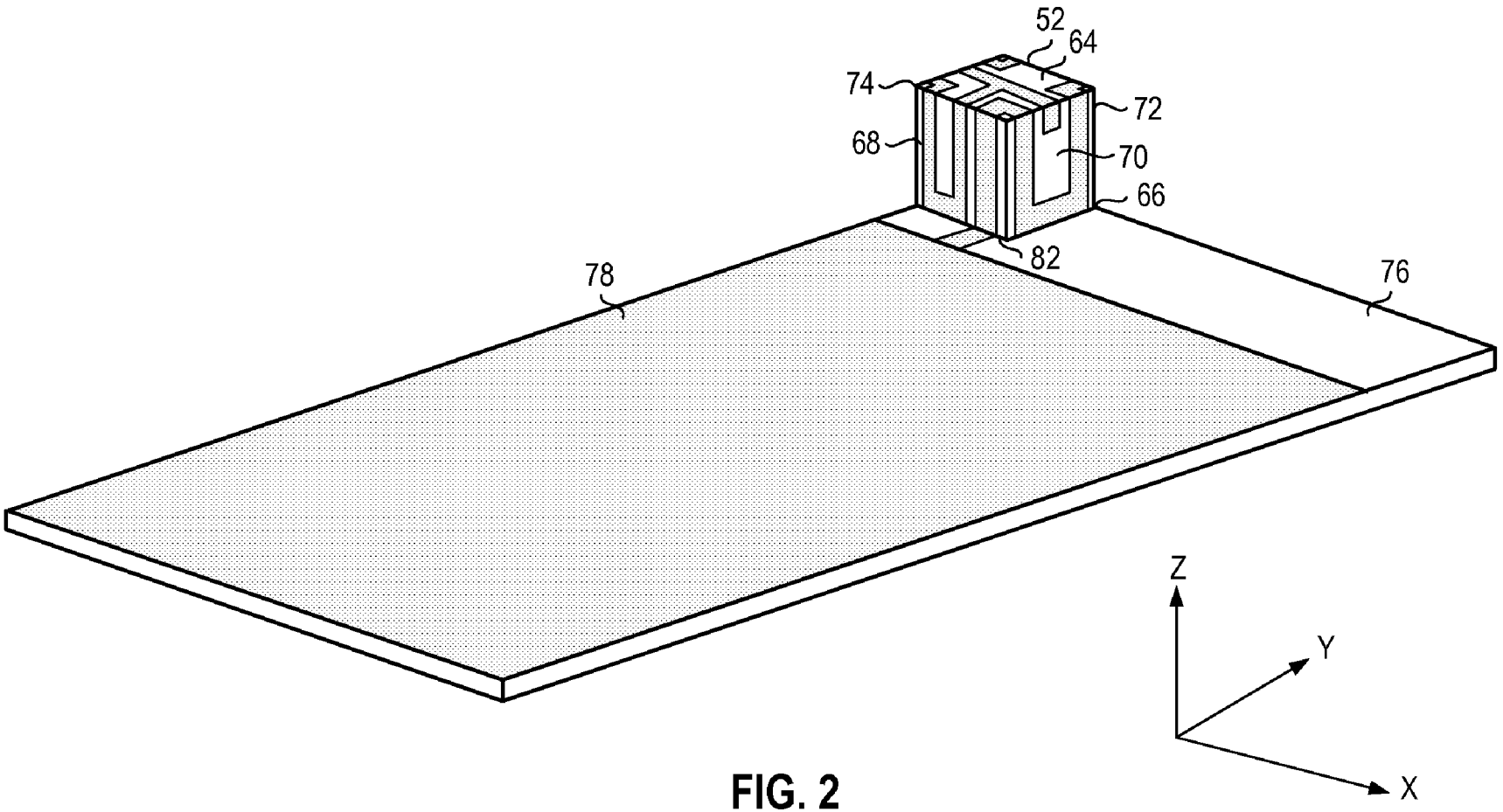
FIG. 2 illustrates a perspective view of an embodiment of the present invention.

FIG. 2 illustrates an exemplary implementation of a multi-band strip antenna 50 for the multi-band communications device 12, depicted in FIG. 1. The multi-band strip antenna 50 is comprised of a dielectric antenna substrate 52 having the shape of right rectangular parallelepiped but which is also accurately described as a type of three-dimensional rectilinear body. The parallelepiped-shaped antenna substrate 52 shown in FIG. 2 is more commonly known as a cube, which of course has six rectangular, i.e., square, sides, denominated here as a top face 64, bottom face 66 and four side faces 68, 70, 72 and 74 that extend between corresponding edges of the top face 64 and bottom face 66.

Inasmuch as the antenna substrate 52 is in the shape of a cube, the top face 64 and bottom face 66 are planar or at least substantially planar and lie in corresponding parallel but spaced-apart geometric planes, the separation distance of which defines the height, H, of the cube. The side faces 68, 70, 72 and 74 of the antenna substrate 52 are also planar or substantially planar and orthogonal to the top face 64 and the bottom face 66 with faces adjacent to each other also being orthogonal to each other.

In FIG. 2, the antenna 50 is depicted atop a substantially planar dielectric supporting substrate 76 to which a metal ground plane 78 is also attached. When the antenna 50 and supporting substrate 76 with the ground plane 78 as shown in FIG. 2 are used in a mobile communications device 12, the ground plane 78 acts to shield circuitry of the device 12 from signals emitted from the antenna as well as electromagnetic interference or EMI from external sources. The ground plane 78 also shapes the radiation pattern of the antenna 50.

In one embodiment, a three-dimensional rectilinear antenna substrate 52 depicted is fabricated as a solid piece of molded dielectric material, in which case, the substrate will of course have multiple sides. A cube-shaped substrate 52 will have six sides. In embodiments where the antenna substrate 52 is solid, the bottom face 66 of the substrate 52 will abut a surface of the supporting substrate 76 when the antenna substrate 52 is mounted atop a supporting substrate 76. Since a solid substrate 52 will add weight and cost, in at least one other embodiment, the three-dimensional rectilinear antenna substrate 52 is not solid but is instead constructed from one or more separate panels of dielectric material that is folded into a desired shape for the antenna substrate 52. In yet another embodiment, the parallelepiped is constructed from several separate discrete panels affixed to each other. Various well-known methods of attachment can be used including, but not limited to, adhesives, heat, ultrasonic welding or mechanical fasteners.

In embodiments where the antenna substrate 52 is not solid but is instead composed of multiple panels and therefore hollow, a cube-shaped antenna substrate 52 can have either five or six sides, the construction of which is referred to herein as being a panelized substrate. In embodiments wherein a panelized antenna substrate 52, such as a cube-shaped substrate is constructed to have only five sides and which is then mounted to a separate supporting substrate 76, the portion of the supporting substrate 76 that is directly below the hollow antenna substrate 52 is then considered to be a de facto "side" of the antenna substrate 52. The portion of the supporting substrate 76 directly below the antenna substrate 52 is considered herein to be the "bottom" face 66 of the parallelepiped antenna substrate 52.

FIG. 3 is a close-up, perspective view of the embodiment of the multi-band antenna 50 depicted in FIG. 2, showing in greater detail how the antenna 50 depicted in FIG. 2 is constructed using a three-dimensional rectilinear body as an antenna substrate 52.

As can be seen in FIG. 3, a radiation element 80 of the antenna 50 is a single, elongated strip of metal or other conductive material folded around the faces 64-74 of a cube-shaped antenna substrate 52, except for the bottom face 66, to which the antenna substrate 52 is attached. As with any end-fed strip antenna, the strip that forms the radiation element 80 has a feed point 82, whereat radio frequency signals for transmission from the antenna 50 are introduced to the antenna 50 from a transmitter and whereat radio signals received by the antenna 50 are recovered from the antenna 50 by a receiver. In the embodiment shown in FIG. 3, the feed point 82 is located at the edge 84 formed by the intersection of the bottom face 66 and one of the side faces 68. In alternate embodiments of the antenna 50, the feed point 82 is located away from an edge, e.g., at the interior of the strip connecting the antenna and the ground plane.

The radiation element 80 has length, width and thickness, the length of which is chosen to be approximately one-quarter the wavelength of a signal in the antenna's fundamental band, e.g., the 800 Mhz band. As will be appreciated from the figures and description below, the length and width will determine the resonant frequencies and characteristic impedances of the antenna 50, however, the width of the strip is also chosen to allow the radiation element 80 to be folded over the faces of the parallelepiped-shaped substrate without having the segments overlap or abut each other.

Note that a "T"-shaped impedance matching element 88 is located at the terminus end 90 of the strip. The input impedance of the antenna 50 at the feed point 82 can thereby be adjusted by varying the length as well as the width of the impedance matching element 88. As with the metal strip that forms the radiation element 80, the metal strip or strips forming the impedance matching element 88 are also disposed on one or more faces of the antenna substrate 52. In the embodiment shown, the impedance matching element 88 wraps over the top face 64 and two side faces 70 and 74.

Segments forming the radiation element 80 and segments forming the impedance matching element 88 can be over coated with a thin layer of insulative material (not shown). A non-conductive, i.e., insulative material deposited over the segments can reduce or prevent oxidation of the segments, prevent the segments from being separated from surfaces of the antenna substrate 52 but also prevent the segments from being short circuited during or after installation of the antenna 50 into a mobile device 12.

FIG. 4 is another close-up perspective view of the antenna 50 depicted in FIG. 3 albeit from a different direction. FIG. 4 therefore further illustrates how the metal strip forming the radiation element 80 and the impedance matching section 88 are wrapped around the parallelepiped shaped antenna substrate 52.

Figure 5:
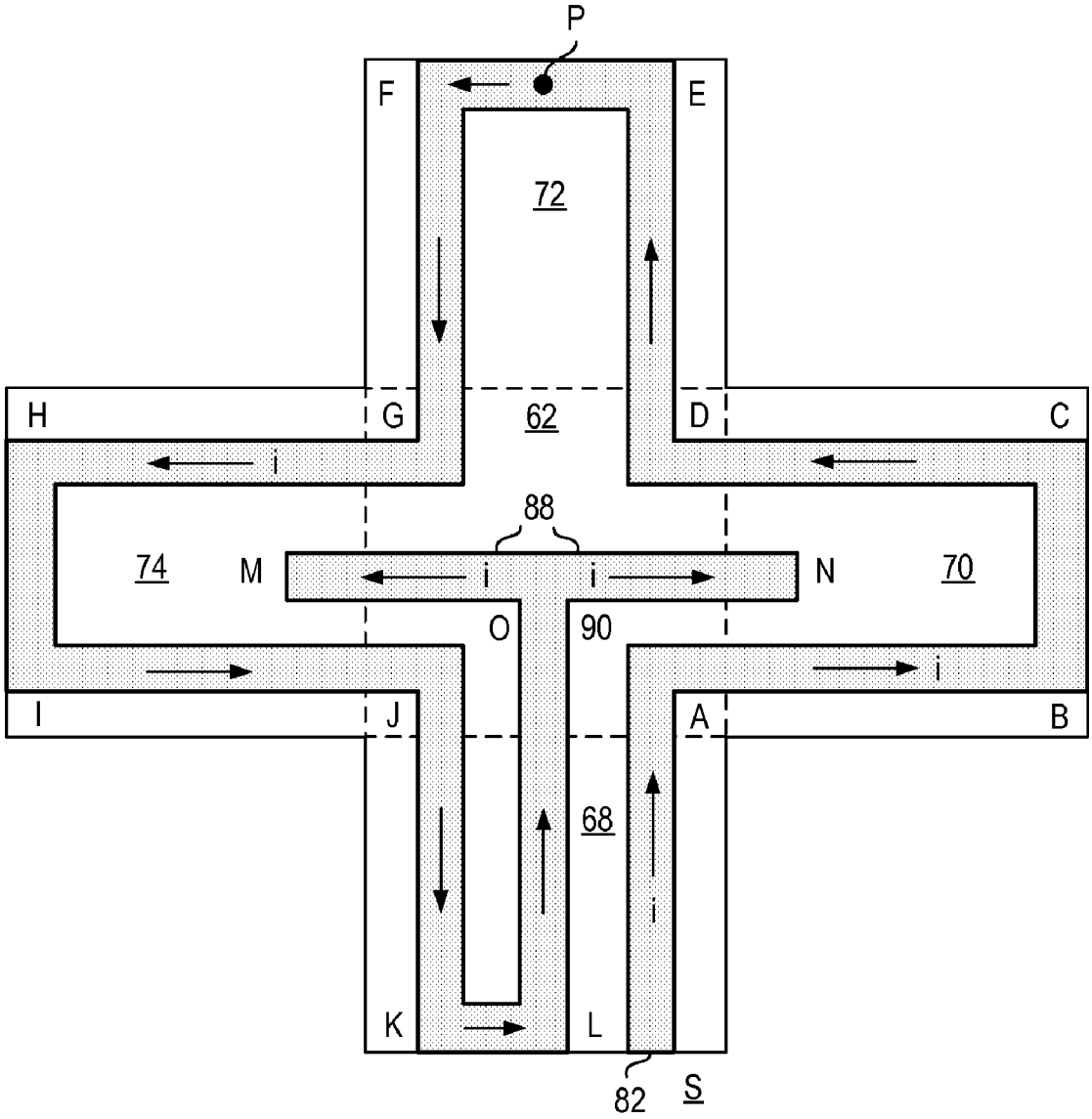
FIG. 5 illustrates a plan view of the antenna depicted in FIG. 2 with the faces of the substrate unfolded and depicting antenna current flow in the two low or fundamental frequency bands of 800 and 900 MHz.
Figure 6:
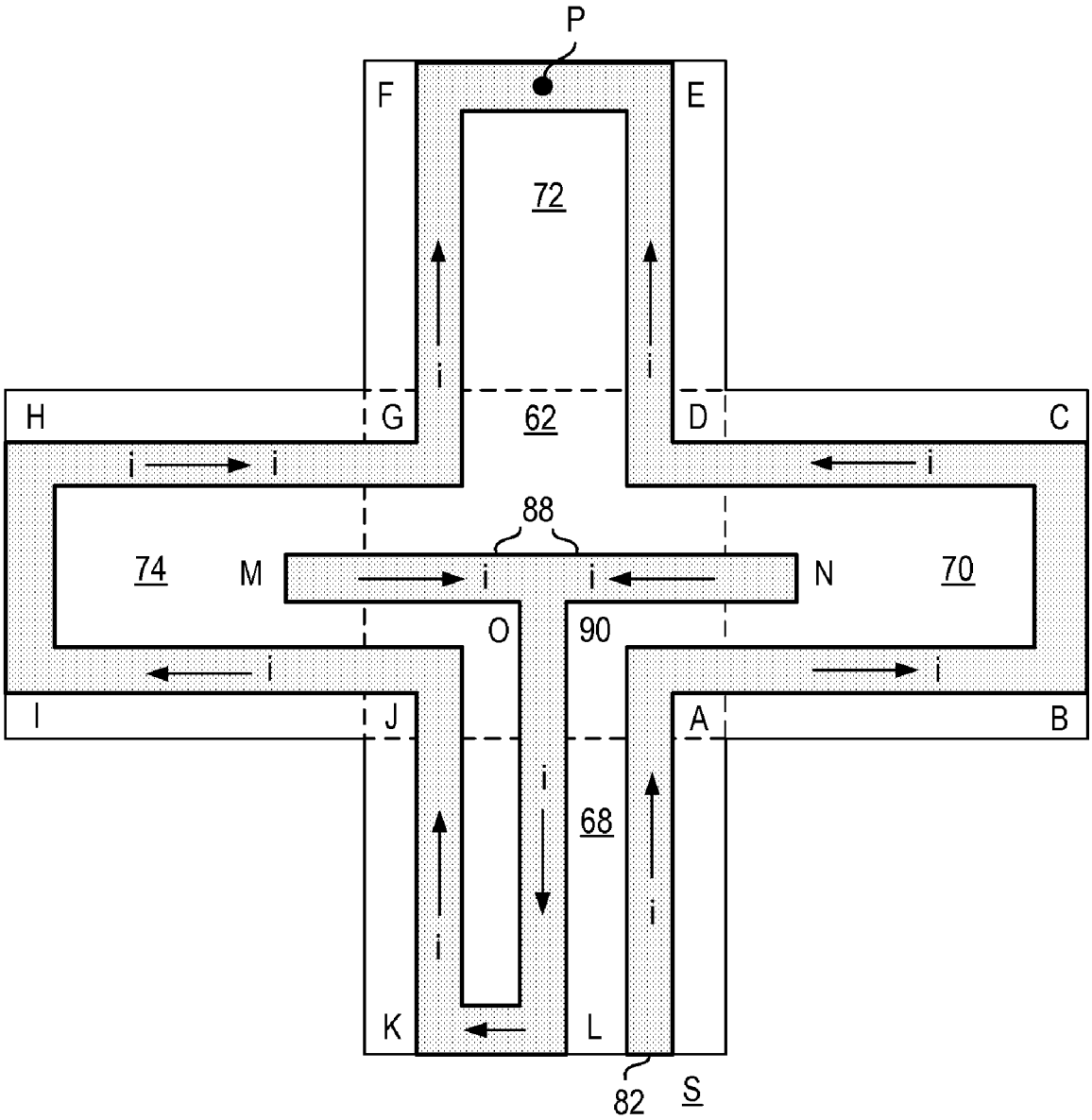
FIG. 6 illustrates a plan view of the antenna depicted in FIG. 2 with the faces of the substrate unfolded as in FIG. 5 but instead depicting antenna current flow in the high fundamental frequency bands of 1800 and 1900 MHz.

An even better understanding of the construction and operation of the antenna 50 can be had from FIGS. 5 and 6, which are plane views of the antenna depicted in FIG. 2 albeit with the faces of the antenna substrate 52 unfolded with the radiation element 80 still on them. FIG. 5 differs from FIG. 6 in that FIG. 5 depicts antenna 50 current distributions in the 800 and 900 MHz bands whereas FIG. 6 depicts current distributions of the same antenna in the 1800 and 1900 MHz. bands.

FIGS. 5 and 6 both show that the radiation element 80 can be considered to be several separate but electrically and physically contiguous elongated planar conductive segments, the segment end points of which being identified in the figures by the letters S, O, and A through L. The various segments that comprise the radiation element 80 are therefore denominated as SA, AB, BC, CD, DE, EF, FG, GH, HI, IJ, JK, KL and LO. The segments are connected to each other in series and extend between the feed point 82 of the antenna 50 and the impedance matching element 88 at the terminus end 90. The sum of the lengths of all the segments SA, AB, BC, CD, DE, EF, FG, GH, HI, IJ, JK, KL, LO, including the length of at least one of segments OM or ON of the impedance matching element 88, are responsible for achieving low frequency band resonances, which for the mobile communications device shown in FIG. 1 were 800 and 900 MHz bands.

Because of the symmetry of the layout of the segments on the antenna substrate 52, a zero current point occurs at the geometric center point P of the antenna 50. The geometric center point for the high frequency bands i.e., the 1800, 1900 and 2100 MHz bands will shift however along the EF at various different frequencies of operation. The shifting zero current point P makes the current flow along the strips in the Y direction, i.e., strips IH and BC, and current flowing along the strips in the Z direction, i.e., strips DE and GF, HG and CD, JI and AB, KJ and SA, to be in-phase with respect to each other, resulting in high gain, uniform radiation patterns for the cube-shaped antenna 50, as depicted in FIGS. 7A and 7B.

Note that for every two segments that are electrically connected to each other, such as the segments AB and BC, or BC and CD, or DE and EF, one of them extends at least part way across two adjacent faces of the substrate so that one of the segments folds over an edge of the cube to allow the metal strip forming the radiation element to change direction and extend onto an adjacent face. Stated another way, segments of the radiation element 80 that are electrically and physically adjacent to each other in the concatenation of elements SA, AB, BC, CD, DE, EF, FG, GH, HI, IJ, JK, KL and LO, are also orthogonal to each other at their points of connection.

By way of example, segment SA is connected to segment AB on the top surface 64. As can be seen in FIGS. 3 and 4, the portions of segments SA and AB on the side faces 68 and 70 are parallel, however, SA and AB are orthogonal to each other where they meet, i.e., on the top surface 64. Consider also segment CD, which extends over a side face 70 as well as part way over the top surface 64. While segment CD is orthogonal to segment BC where they meet on the side face 70. Segment CD is also orthogonal to segment DE where CD and DE meet on the top surface 64. Thus two successive segments SA, AB, BC, CD, DE, EF, FG, GH, HI, IJ, JK, KL and LO, are orthogonal to each other where they meet on the surfaces of the antenna substrate 52.

Figure 7A:
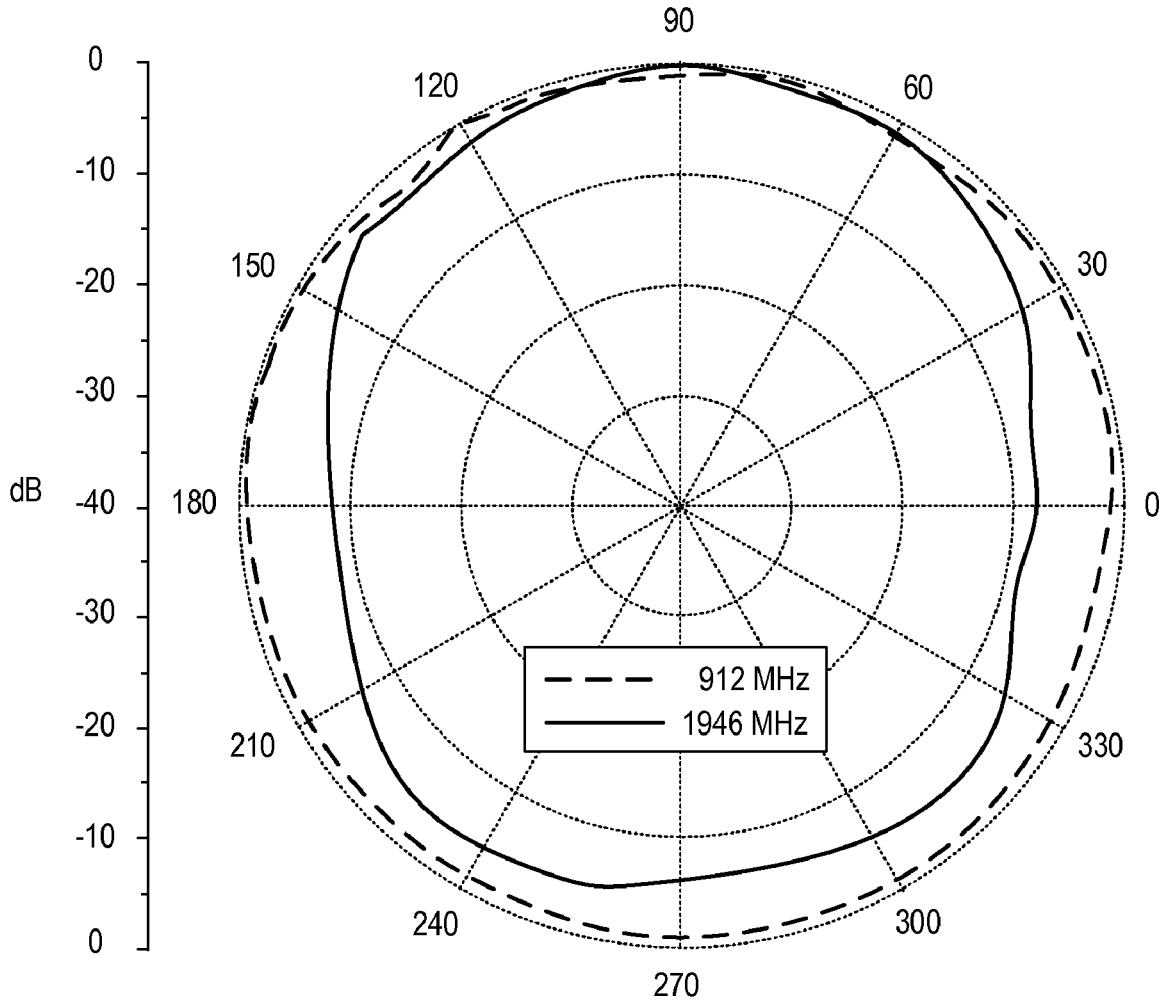
FIGS. 7A and 7B illustrate radiation patterns of the antenna shown in FIG. 2 in two orthogonal planes, at two different frequencies.
Figure 7B:
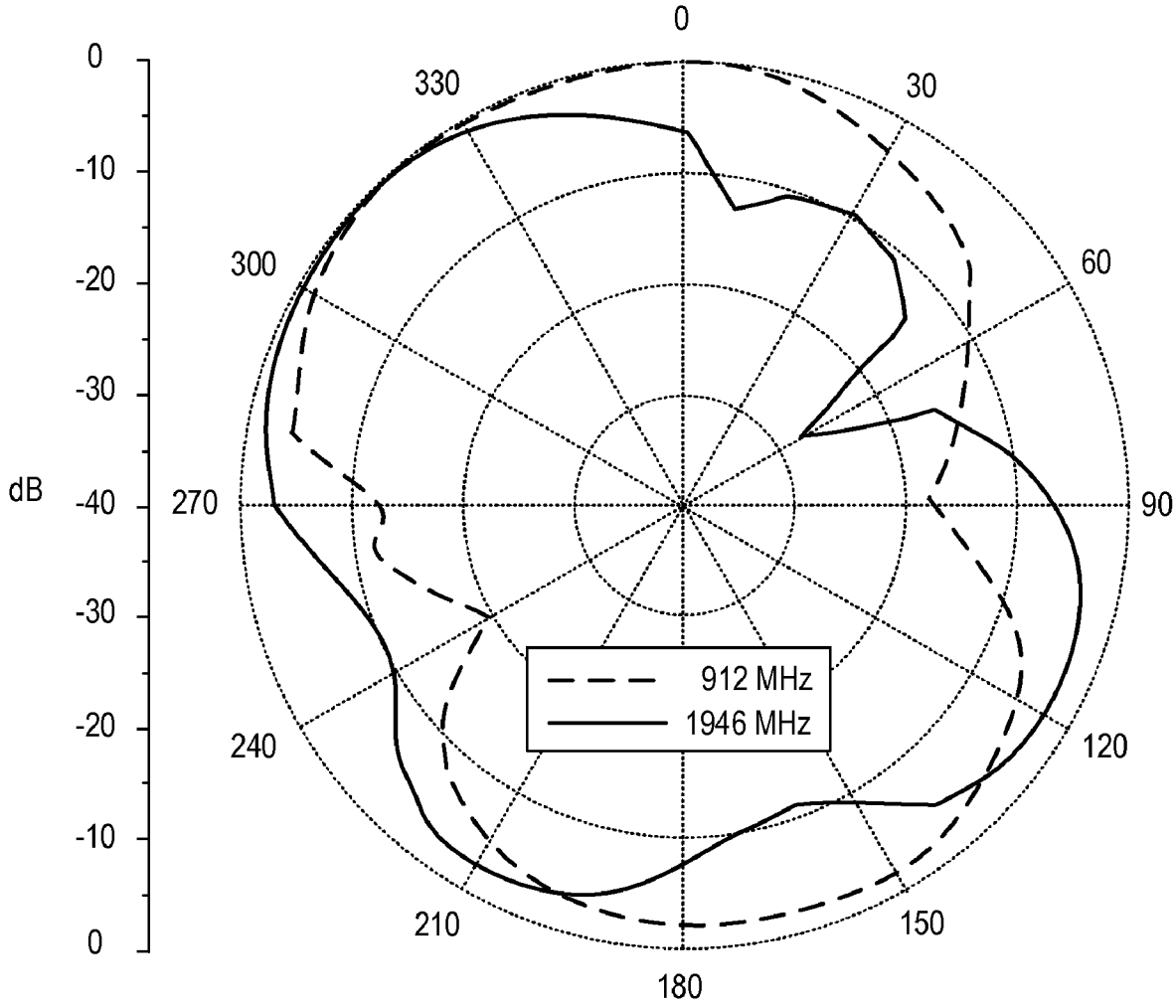

FIGS. 7A and 7B illustrate graphical representations of measured radiation patterns of the antenna 50 depicted in FIG. 2 at both 912 MHz and 1946 MHz. As can be seen in FIG. 7A, the antenna 50 has a radiation pattern in the ZX plane (as marked in FIGS. 2-4) which is a nearly perfect circle at 912 MHz. The radiation pattern is also substantially circular at 1946 MHz. FIG. 7B shows that the antenna 50 has fairly good circular radiation patterns in the YZ plane, (as marked in FIGS. 2-4) at both 912 MHz and at 1946 MHz. The radiation pattern emitted from the mobile communication device 12 can therefore be chosen to be at least one of those depicted in FIGS. 7A and 7B, by simply orienting the antenna substrate 52 within a mobile communications device 12 so that the ZX plane is parallel, orthogonal to or oriented in some other fashion to obtain a desired radiation pattern relative to the earth's surface.

Figure 8:
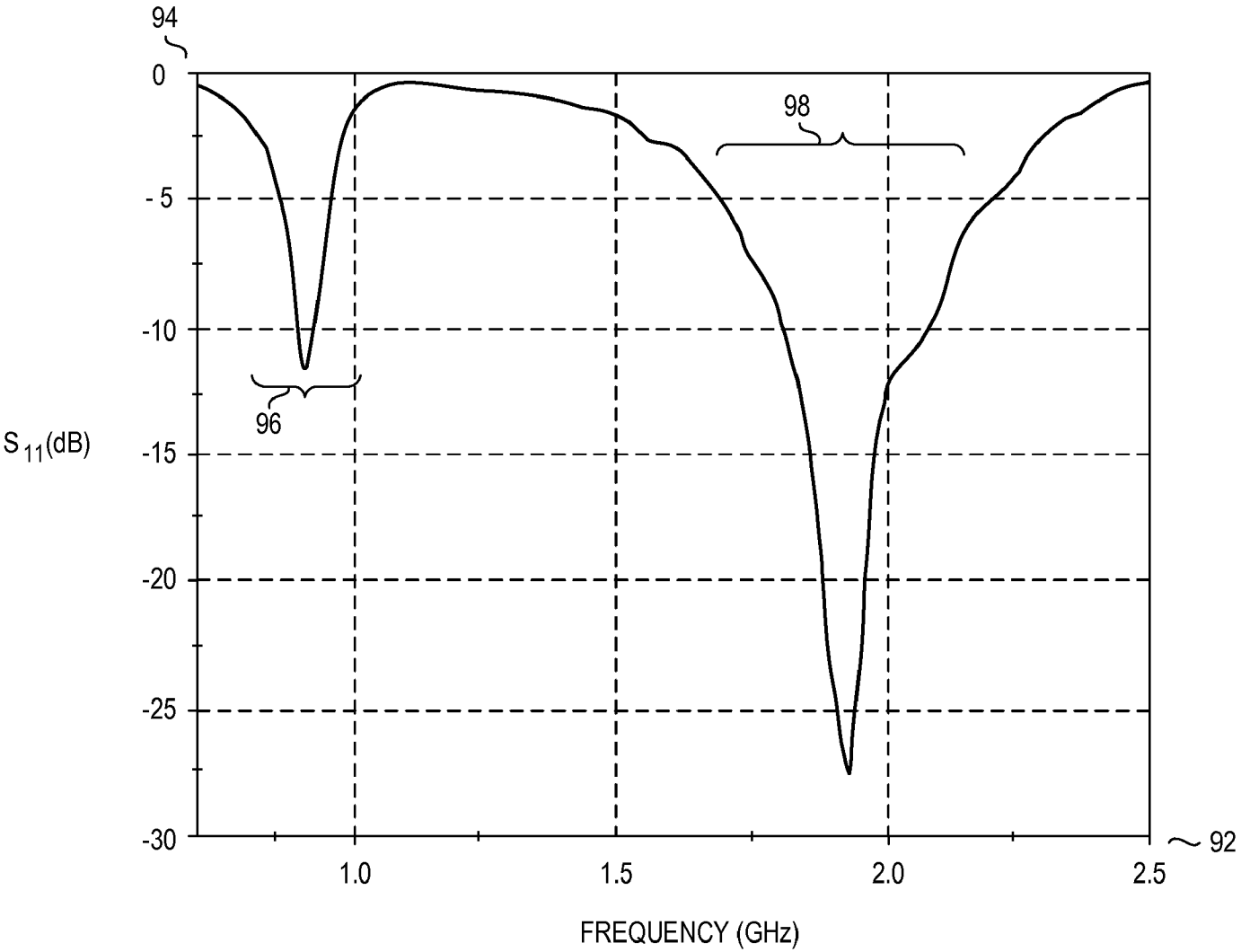
FIG. 8 illustrates a plot of the antenna's return loss as a function of an input signal frequency.

Referring now to FIG. 8 there is shown a plot of the return-loss of the antenna 50 depicted in FIGS. 2-4 as a function of frequency. The frequency of signal input to the antenna at the feed point 82 is plotted along the abscissa or X-axis 92. The ordinate or Y-axis 94 is scaled in terms of return loss in decibels or dB.

The antenna 50 depicted in FIGS. 2-4 exhibits a pass band 96 between approximately 800 MHz and 900 MHz. A second pass band 98 extends between approximately 1600 MHz and 2200 MHz. As shown by the FIG. 8, the antenna will efficiently transduce RF signal energy anywhere within the pass bands 94 and 96. The pass bands and their corresponding frequencies therefore define frequency bands wherein a multi-mode communications device can operate efficiently.

Figure 9:
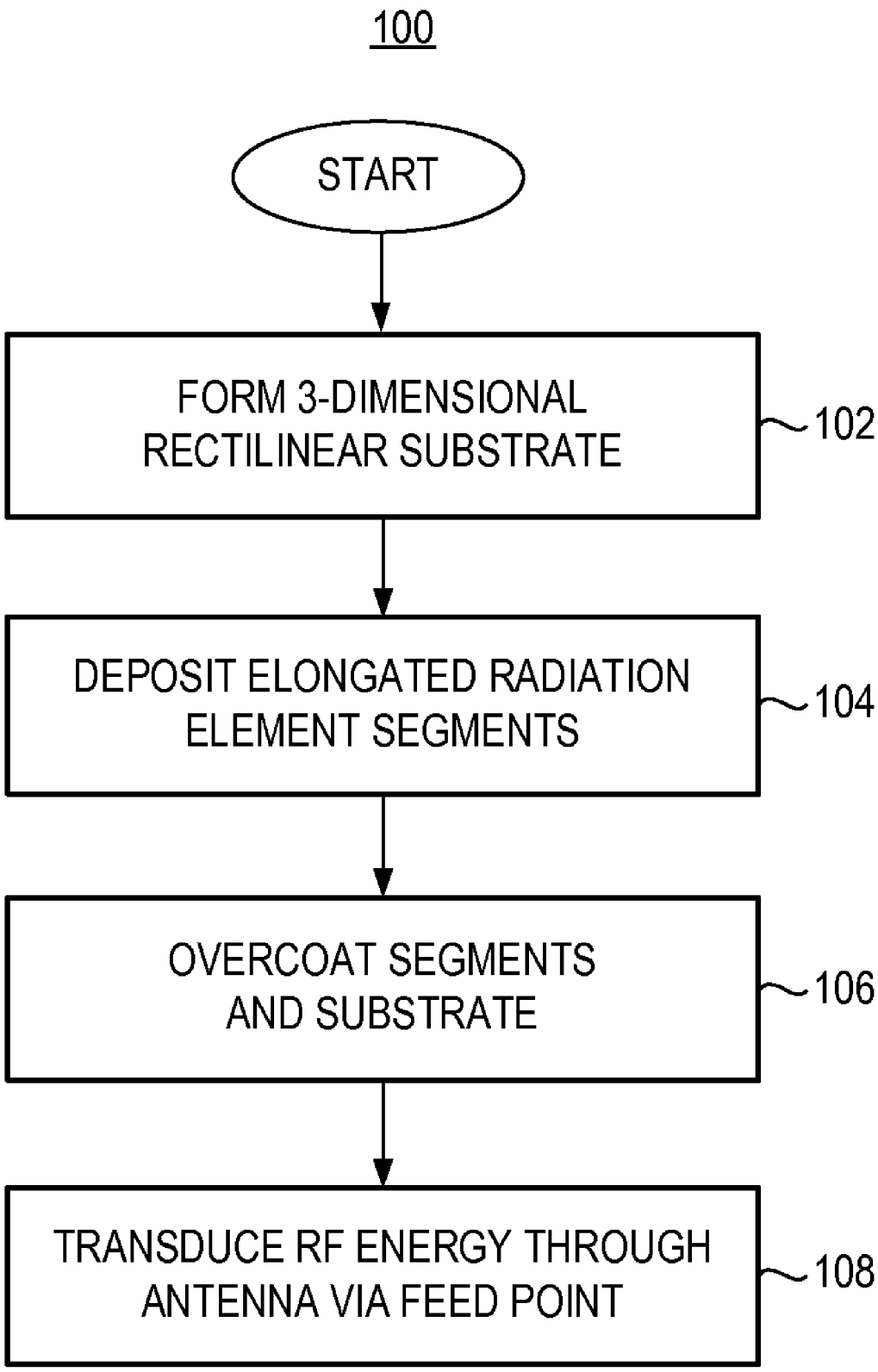
FIG. 9 illustrates a method flow diagram in accordance with an embodiment of the present invention.

FIG. 9 illustrates a method flow diagram, shown generally at 100, representative of a method of operation of an embodiment of the present invention. The method provides for transducing signal energy at a radio device.

First, and as indicated by the block 102, a three-dimensional rectilinear substrate is formed, such as the cube depicted in the figures described above. As indicated in block 104, a first radiation element is formed and deposited onto the surface of the substrate.

The radiation element is formed in the shape of an elongated, thin strip of metal or other conductive material. The strip has a predetermined length, which is substantially equal to one-quarter the wavelength of the lowest frequency band at which the antenna will operate. It is important that the antenna strip be provided with a feed point, such as the one described above, whereat signal energy can be introduced to and obtained from the antenna.

The radiation element can be formed upon the faces of the antenna substrate by different methods. Such methods include but are not limited to, electro-plating, chemical vapor deposition or CVD or by adhesives. In one embodiment, the segments forming the radiation element and the surfaces of the antenna substrate are overcoated with a thin layer of dielectric material as indicated by step 106, which will protect the segments from oxidation as well as inadvertent short circuiting.

As shown in block 108, radio frequency signal energy is then transduced within first, second, third or fourth sets of frequency bands at which the radiation element is resonant.

The antenna 50 described above defines a strip antenna of small dimensions and which is easily positioned within the housing of a compact mobile station. The antenna enables a mobile station to operate on multiple frequency bands, including the quad-bands of a quad-mode mobile station operable at the 800/900/1800/1900 MHz frequency bands, however, the foregoing description should not be construed as limiting because the inventive concept extends to antenna substrates that are not necessarily cube-shaped.

While the embodiment depicted in the figures and described above used an antenna substrate in the shape of a cube having the radiation element 80 around its faces, a more general description of the antenna 50 is that the antenna is formed from a substrate 52 in the shape of any three-dimensional rectilinear dielectric body. A radiation element 80 is disposed on, i.e., wrapped around, multiple sides of the body, with the possible exception of one face on which the substrate is attached to a supporting substrate or mobile unit. The antenna substrate 52 and the radiation element 80 are sized together so that it can fit within the small and confined spaces of a multi-band mobile unit 12 yet transduce radio frequency energy in multiple different frequency bands.

Three-dimensional rectilinear bodies that are usable to form an antenna include but are not limited to, truncated prisms and truncated pyramids, and parallelepipeds generally, e.g., cubes and cuboids, whether such bodies are solid or hollow. As used herein, a truncated prism is considered to be any polyhedron with two polygonal faces lying in parallel planes and with the other faces that connect the two polygonal faces being parallelograms. The polygonal faces can include regular polygons such as triangles, squares, rectangles, pentagons, octagons as well as irregular polygons. The parallelogram sides can include rectangles and squares. In such a body, the two polygonal faces may or may not correspond to the top face 64 and the bottom face 66 of the cube described above.

A pyramid is of course a polyhedron having for its base a polygon and faces that are triangles with a common vertex. A truncated pyramid is therefore a pyramid with a top portion that is removed to provide a flat top in the shape of a regular polygon. The sides of a truncated pyramid are trapezoidal. In a truncated pyramid, the shape of the bottom face and the shape of the top face will be the same but with the bottom face being larger than the top. The slope or inclination of the sides is a design choice and can vary from just over 90 degrees to virtually any angle.

It will be recognized by those of ordinary skill in the art that as the shape of the antenna substrate 52 varies from a cube, the spatial relationships between antenna segments on differently arranged faces will also vary. As the spatial relationship between the segment vary, the pattern of RF signal energy is radiated from them will also vary. It is therefore expected that an emitted radiation pattern for an antenna formed from a substrate other than the cube depicted in FIGS. 2-4 will likely vary from the radiation patterns depicted in FIGS. 7A and 7B. The true scope of the invention is defined by the appurtenant claims.

By using three-dimensional wrapping, the antenna disclosed herein significantly reduces the physical size or extension of a multi-band antenna while also increasing the bandwidth of the antenna. Increasing bandwidth is equivalent to reducing the energy stored around the antenna.

The compact size of the three-dimensional wrapped antenna also lends itself to use in multiple antenna systems, including multiple input and multiple output (MIMO) antenna systems. Because of their size, prior art antennas cannot be used to implement a MIMO antenna system in a portable communications device.

Presently preferred embodiments of the invention and many of its improvements and advantages have been described with a degree of particularity. The description is of preferred examples of implementing the invention, and the description of preferred examples is not necessarily intended to limit the scope of the invention. The scope of the invention is defined by the following claims.

What is claimed is:

1. A multi-band strip antenna for a communication device, the antenna comprising:

a three-dimensional rectilinear antenna substrate having a plurality of substantially planar faces; and a radiation element formed of a plurality of elongated planar conductive segments, each of which is disposed upon at least one face of the three-dimensional rectilinear antenna substrate, a first segment disposed at least on a first face of said substrate, a second segment disposed at least on a second face of said substrate, said second face in orthogonal orientation to said first face, and a third segment disposed at least on a third face of said substrate, said third face in orthogonal orientation to said first face and said second face, such that the plurality of segments are electrically coupled one to another in series, the combined lengths of the segments being selected to be substantially equal to a one-quarter wavelength at a lowest frequency band of two different frequency bands in which the strip antenna is capable of operating and of a length that a zero electrical current point is created at substantially the geometric center of said combined length series coupled segments at a highest frequency band of said two different frequency bands.

2. The strip antenna of claim 1, further comprising a T-shaped impedance matching element coupled with a terminus end of the radiation element, said T-shaped impedance matching element disposed on at least one surface of the antenna substrate.

3. The strip antenna of claim 2, farther comprising an insulative layer deposited over at least one of: the radiation element and the T-shaped an impedance matching element.

4. The strip antenna of claim 1, wherein at least two faces of the three-dimensional rectilinear antenna substrate are substantially rectangular.

5. The strip antenna of claim 1, wherein at least two faces of the three-dimensional rectilinear antenna substrate are parallelograms.

6. The strip antenna of claim 1, wherein the three-dimensional rectilinear antenna substrate is in the shape of a cube.

7. The strip antenna of claim 1, wherein the radiation element is sized, shaped and arranged to transduce signal energy in a plurality of different frequency bands.

8. The strip antenna of claim 7, wherein the plurality of different bands include at least two of: the 800 Mhz band; the 900 Mhz band; the 1800 Mhz band; and the 1900 Mhz band.

9. The strip antenna of claim 7, wherein the plurality of different bands include at least: the 800 Mhz band; the 900 Mhz band; the 1800 Mhz band; and the 1900 Mhz band.

10. The strip antenna of claim 8, wherein the pattern of radiation emitted from the antenna in the 900 MHz band is substantially circular, in at least one direction.

11. The strip antenna of claim 1 wherein said plurality of elongated planar conductive segments disposed on said three dimensional rectilinear antenna substrate in a configuration that is substantially a mirror image about a plane parallel to at least one face and bisecting said substrate.

12. The strip antenna of claim 11 wherein electric currents at a highest frequency band of said two different frequency bands flow in said conductive segments in mirror image directions referenced to said plane.

13. The strip antenna of claim 1 wherein said electrical coupling of one segment to another further comprises a physically orthogonal connection between two coupled segments, said physically orthogonal connection and at least a portion of said coupled two segments disposed on one face of said substrate.

14. A multi-band strip antenna for a communication device, said strip antenna comprising:

a dielectric antenna substrate in the shape of a cube having a plurality of faces;

a radiation element formed of a plurality of N elongated planar and conductive segments of conductive material disposed on surfaces of the cube such that they are electrically coupled one to another other in series, the series-coupled segments defining a feed point for the antenna and a terminus end that is opposite the feed point; and an impedance matching element comprised of a length of conductive material electrically coupled with the radiation element, each segment of the plurality of segments extending at least part way across a face of the substrate, the radiation element having a physical length equal to the combined length of the N segments such that the radiation element is folded over and disposed on a plurality of the faces of the substrate, a first segment disposed at least on a first face of said substrate, a second segment disposed at least on a second face of said substrate, said second face in orthogonal orientation to said first face, and a third segment disposed at least on a third face of said substrate, said third face in orthogonal orientation to said first face and said second face.

15. The strip antenna of claim 14, wherein the combined lengths of the N segments is substantially equal to a quarter wavelength of a first operating band of the antenna.

16. The strip antenna of claim 14 wherein said plurality of N elongated planar conductive segments are disposed on said dielectric antenna substrate in a configuration that is substantially a mirror image about a plane parallel to at least one face and bisecting said substrate and wherein electric currents at a highest frequency band of said two different frequency bands flow in said conductive segments in mirror image directions referenced to said plane.

17. The strip antenna of claim 14 wherein said combined lengths of said N segments are of a length that a zero electrical current point is created at substantially the geometric center of said combined lengths at a highest frequency band of said two different frequency bands in which the strip antenna is capable of operating.

18. A method of transducing radio frequency energy from a multi-band communication device comprising the steps of:

forming a three-dimensional rectilinear substrate, said substrate having a plurality of external surfaces; and depositing an elongated, thin strip of conductive material, having a predetermined length, onto a plurality of the external surfaces of the three-dimensional rectilinear substrate in a configuration that is substantially a mirror image about a plane parallel to at least one face and bisecting said substrate, and further comprising the steps of:

depositing a first segment of said strip of conductive material on at least a first face of said substrate, depositing a second segment of said strip of conductive material on at least a second face of said substrate, said second face oriented orthogonally to said first face, and depositing a third segment of said strip of conductive material on at least a third face of said substrate, said third face oriented orthogonally to said first face and said second face, the strip of conductive material defining a feed point for the antenna.

19. The method of claim 18 further including the step of: transducing radio frequency signal energy at the feed point, the radio frequency energy being in at least one of four different frequency bands at which the radiation element is resonant.

20. The method of claim 18, wherein the step of forming includes the step of forming a cube.

21. The method of claim 18 further comprising a step of over coating at least a portion of the conductive material.

22. The method of claim 18, wherein the step of depositing includes the step of depositing a strip having a length substantially equal to one-quarter the wavelength of a lowest frequency band at which the antenna will operate.

23. The method of claim 18 wherein the step of depositing includes at least one of: electro-plating; chemical vapor deposition; and adhesion.

24. The method of claim 18 further including the step of transducing radio frequency energy within at least one of at least first and second frequency bands at which the radiation element is resonant.

25. The method of claim 18 wherein the step of depositing includes the step of depositing a strip having a length such that a zero electrical current point is created at substantially the geometric center of said length at a highest frequency band of said two different frequency bands in which the strip antenna is capable of operating.

26. A multi-band strip antenna for a communication device, the antenna comprising:

a dielectric substrate in the shape of a cube having a plurality of faces;

a radiation element formed of a plurality of electrically and physically contiguous elongated planar conductive segments connected one to another in series and extending from a feed point to a terminus end, said feed point coupled to a first segment having a first portion thereof disposed on a first face of said substrate and a second portion disposed on an adjacent second face of said substrate and orthogonally coupled to a first portion of a second segment on said second face of said substrate, a second portion of said second segment disposed on a third face of said substrate and coupled to a first portion of a third segment on said third face of said substrate, a second portion of said third segment disposed on said second face of said substrate and orthogonally coupled to a first portion of a fourth segment disposed on said second face of said substrate, a second portion of said fourth segment disposed on a fourth face of said substrate and coupled to a first portion of a fifth segment on said fourth face of said substrate, a second portion of said fifth segment disposed on said second face of said substrate and orthogonally coupled to a first portion of a sixth segment disposed on said second face of said substrate, a second portion of said sixth segment disposed on a fifth face of said substrate and coupled to a first portion of a seventh segment on said fifth face of said substrate, a second portion of said seventh segment disposed on said second face of said substrate and orthogonally coupled to a first portion of an eighth segment disposed on said second face of said substrate; and an impedance matching element, comprising a length of conductive material disposed on a face of said substrate and electrically coupled to said radiation element.

27. A multi-band strip antenna of claim 26 wherein said impedance matching element further comprises an electrical coupling to said radiation element at said terminus end and a deposition location on said second face of said substrate.

28. A multi-band strip antenna for a communication device, the antenna comprising:

a three-dimensional rectilinear antenna substrate having a plurality of substantially planar faces; and a radiation element formed of a plurality of elongated planar conductive segments, each of which is disposed upon at least one face of the three-dimensional rectilinear antenna substrate in a configuration that is substantially a mirror image about a plane parallel to at least one face and bisecting said substrate, a first segment disposed at least on a first face of said substrate, a second segment disposed at least on a second face of said substrate, said second face in orthogonal orientation to said first face, and a third segment disposed at least on a third face of said substrate, said third face in orthogonal orientation to said first face and said second face, such that the plurality of segments are electrically coupled one to another in series, the combined lengths of the segments being selected to be substantially equal to a one-quarter wavelength at a lowest frequency band of two different frequency bands in which the strip antenna is capable of operating.

29. The strip antenna of claim 28, further comprising a T-shaped impedance matching element coupled with a terminus end of the radiation element, said T-shaped impedance matching element disposed on at least one surface of the antenna substrate.

30. The strip antenna of claim 29, further comprising an insulative layer deposited over at least one of: the radiation element and the T-shaped an impedance matching element.

31. The strip antenna of claim 28, wherein the three-dimensional rectilinear antenna substrate is in the shape of a cube.

32. The strip antenna of claim 28, wherein the radiation element is sized, shaped and arranged to transduce signal energy in a plurality of different frequency bands.

33. The strip antenna of claim 32, wherein the plurality of different bands include at least two of: the 800 Mhz band; the 900 Mhz band; the 1800 Mhz band; and the 1900 Mhz band.

34. The strip antenna of claim 33, wherein the pattern of radiation emitted from the antenna in the 900 MHz band is substantially circular, in at least one direction.

35. The strip antenna of claim 28 wherein said combined lengths of said series coupled segments are of a length that a zero electrical current point is created at substantially the geometric center of said combined length series coupled segments at a highest frequency band of said two different frequency bands in which the strip antenna is capable of operating.

36. The strip antenna of claim 28 wherein electric currents at a highest frequency band of said two different frequency bands flow in said conductive segments in mirror image directions referenced to said plane.

37. The strip antenna of claim 28 wherein said electrical coupling of one segment to another further comprises a physically orthogonal connection between two coupled segments, said physically orthogonal connection and at least a portion of said coupled two segments disposed on one face of said substrate.

38. A method of transducing radio frequency energy from a multi-band communication device comprising the steps of:

forming a three-dimensional rectilinear substrate, said substrate having a plurality of external surfaces; and depositing an elongated, thin strip of conductive material, having a length such that a zero electrical current point is created at substantially the geometric center of said length at a highest frequency band of said two different frequency bands in which the strip antenna is capable of operating, onto a plurality of the external surfaces of the three-dimensional rectilinear substrate, and further comprising the steps of:

depositing a first segment of said strip of conductive material on at least a first face of said substrate, depositing a second segment of said strip of conductive material on at least a second face of said substrate, said second face oriented orthogonally to said first face, and depositing a third segment of said strip of conductive material on at least a third face of said substrate, said third face oriented orthogonally to said first face and said second face, the strip of conductive material defining a feed point for the antenna.

39. The method of claim 38, wherein the step of forming includes the step of forming a cube.

40. The method of claim 38 further comprising a step of over coating at least a portion of the conductive material.

41. The method of claim 38, wherein the step of depositing includes the step of depositing a strip having a length substantially equal to one-quarter the wavelength of a lowest frequency band at which the antenna will operate.

42. The method of claim 38 wherein the step of depositing includes at least one of: electro-plating; chemical vapor deposition; and adhesion.

43. The method of claim 38 further including the step of disposing said elongated thin strip of conductive material on said substrate in a configuration that is substantially a mirror image about a plane parallel to at least one face and bisecting said substrate.

* * * * *